US006223924B1

(12) United States Patent
Ek et al.

(10) Patent No.: US 6,223,924 B1
(45) Date of Patent: May 1, 2001

(54) RECLOSABLE OPENING DEVICE FOR PACKAGES FOR POURABLE FOOD PRODUCTS

(75) Inventors: Göran Ek, Lomma (SE); Antonio Troiano, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/367,089

(22) PCT Filed: Mar. 13, 1998

(86) PCT No.: PCT/EP98/01476

§ 371 Date: Aug. 9, 1999

§ 102(e) Date: Aug. 9, 1999

(87) PCT Pub. No.: WO98/41452

PCT Pub. Date: Sep. 24, 1998

(30) Foreign Application Priority Data

Mar. 14, 1997 (IT) ..... MI97A0580

(51) Int. Cl.[7] ..... B65D 5/74; B65D 51/22; B65D 55/02

(52) U.S. Cl. ..... 220/258; 220/277; 220/278; 215/230; 222/81; 222/83; 222/153.06

(58) Field of Search ..... 215/230, 250; 220/255, 256, 258, 267, 266, 265, 277, 278; 272/81, 83, 153.06

(56) References Cited

U.S. PATENT DOCUMENTS

| | | | | |
|---|---|---|---|---|
| 4,588,098 | | 5/1986 | Uzdy . | |
| 5,020,690 | * | 6/1991 | Kishikawa et al. | 222/83 |
| 5,141,133 | | 8/1992 | Ninomiya et al. . | |
| 5,482,176 | * | 1/1996 | Maietta et al. | 222/83 X |
| 5,497,906 | * | 3/1996 | Dubach | 222/153.06 X |
| 5,927,549 | * | 7/1999 | Wood | 222/83 |

FOREIGN PATENT DOCUMENTS

| | | |
|---|---|---|
| 196 22 144 C1 | 7/1997 | (DE) . |
| WO 95/05996 | 3/1995 | (WO) . |

* cited by examiner

*Primary Examiner*—Nathan J. Newhouse
(74) *Attorney, Agent, or Firm*—Burns, Doane, Swecker & Mathis, L.L.P.

(57) ABSTRACT

The reclosable opening device (1) has a frame (2) integratable with a package to be opened, a pouring opening (6) defined by the frame member, and a reclosable cap (4) releasable connected by screw threads (5) to the frame (2) for sealing the pouring opening (6). An indicator member (7) is rotatably associated with the frame (2) and releasably connected to the reclosable cap (4) by rupturable connection bridges (12*a*–12*f*) for indicating a sealed condition of the opening device in a first position. A ratchet mechanism (13, 15–17) is interposed between the frame (2) and the indicator member (7) for retaining the indicator member (7) in a second position, which is spaced from the first position, for indicating an opened condition of the reclosable cap (4).

8 Claims, 7 Drawing Sheets

RECLOSABLE OPENING DEVICE FOR PACKAGES FOR POURABLE FOOD PRODUCTS

TECHNICAL FIELD.

The present invention relates to an opening device for packages containing or intended to contain a pourable or flowable food product. The opening device is particularly suitable for use on aseptic packages containing sterile-treated food product such as fruit juice, heat-treated milk which is subjected to so-called UHT (ultra high temperature) treatment etc., and may be also used for packages containing pasteurised food products such as pasteurised milk.

BACKGROUND ART.

Many commercially available food products, including sterile-treated fruit juice, wine, UHT milk, tomato puree etc., are packed in packages which are manufactured from a previously sterilised or sterile-treated packaging material. A typical example of this kind of package is the parallelepipedal packaging container for liquid or pourable food products, which is known by the name Tetra Brik Aseptic (Registered Trade Mark), which is manufactured by folding and sealing of a web-shaped laminated packaging material. The laminated packaging material comprises layers of fibrous material such as paper, which are coated on either side with a thermoplastic material such as polyethylene. On the side of the laminated packaging material which is destined to be in contact with the food contents of the package, there is also a layer of barrier material, such as e.g., aluminum foil, which is also coated with a thermoplastic layer.

In order to manufacture parallepipedal packaging containers of this type, filling or packaging machines are fed with laminated packaging material in web form. The packaging material web is sterilised in the packaging machine by the application of a chemical sterilization agent such as e.g., hydrogen peroxide solution. Upon completion of sterilization, the sterilization agent is removed from the surfaces of the packaging material, for example, it may be vaporised by heating. The thus sterilised packaging material web is retained in a closed sterile space and is folded and longitudinally sealed to form a tube. The tube is filled with sterile-treated food product and is transversely sealed and cut into pillow-shaped, filled and sealed packaging containers, which are then mechanically folded to form a parallepipedal package.

An example of this type of packaging machine is the TBA19 aseptic filling machine, manufactured by Tetra Brik Packaging Systems, Via Delfini 1, Modena, Italy.

In order to open this type of package, several solutions have been proposed. One solution consisted in the provision of a line of perforations, partially penetrating the outer layers of the laminated packaging material but leaving the internal barrier layer or layers intact, and extending across the comer zone of a flap of the package. By raising the flap and cutting or tearing along the perforations, the package was opened, and the contents could be poured from the package. Such solutions are described in U.S. Pat. No. 4,655,387 and in U.S. Pat. No. 4,410,128.

However, since packages of this type could not be reclosed, they had to be handled in a careful manner to avoid spillage, until all of the contents were used.

In order to overcome this inconvenience, various types of reclosable opening devices have been proposed. One such solution consisted in the provision of an outlet opening formed in the packaging material laminate and a pull-tab applied over the opening in the filling or packaging machine, with a frame-like pouring device having a reclosable lid connected to the outside of the filled and formed package over the pull-tab. In order to access the contents of the package, a user must first open the lid, and then remove the pull-tab. Once the desired quantity of contents has been removed from the package, the lid can be reclosed.

While this solution is extremely advantageous from many standpoints, it has been found to be susceptible to improvement. Specifically, it would be desirable to have an opening device which permits a user to open the above-described type of package in a single operation, and thereafter provide the possibility of package reclosure with improved liquid-tightness.

Packages of the so-called gable-top type are also known, which are usually formed from a packaging material blank on a mandrel and are particularly suitable for pasteurised food products. By pulling apart the ends of a pair of opposite inclined walls of a gable top package, a portion of the uppermost sealed ridge or fin of the package is ruptured, and a spout-like portion can be opened outwards to enable the contents to be poured from the package. However, also this opening arrangement has the disadvantage that it cannot be securely reclosed, and therefore also gable-top packages provided with this type of opening arrangement have to be handled in a careful manner to avoid spillage, until all of the contents are used.

Laid-open Japanese Patent No. 63-149818 describes an opening device used for packages of the gable-top type, which are usually formed from a packaging material blank on a mandrel and are particularly suitable for pasteurised food products. The opening device has a frame affixed to one of the two inclined walls of the gable-top package and bearing two upright semi-circular walls. A lever having a matching semi-circular configuration is journalled between the walls for rotation about an axis passing substantially through the centers of the planar bases of the semi-circular walls, parallel and adjacent to the surface of the package. The lower portion of the lever facing the package has teeth for rupturing the packaging material, and a grip-tab, whereby a user can open the package by rotating the lever in one direction, and reclose the package by rotating the lever in the opposite direction.

However, this kind of opening device requires the application of significant force in order to drive the teeth through the packaging material. This may lead to inadvertent spillage of the contents of the package. Furthermore, the excessive force exerted on the points whereat the lever is journalled to the walls, may cause damage to or even breakage of the device. Moreover, although the device can be reclosed after opening, the reclosure is not liquid-tight, whereby spillage may occur in the event that a reclosed container is accidentally knocked over.

A screw cap provides a better degree of liquid-tightness when reclosed, but when using a screw cap on an aseptic package of the above-described type, some provision has to be made for rupturing the barrier layer of the container at the time of opening, so as to maintain the aseptic quality of the package, right up to the moment when the package is opened for consumption of the product contained therein.

Known from laid-open Japanese Patent Application No. 63-156928 is a three-piece opening device consisting of a frame having an externally threaded portion, a screw-cap which can be screwed onto the frame, and a sleeve located in a tubular portion of the frame and having a lower toothed edge which, when actuated by screwing the cap onto the frame, perforates the laminated packaging material of a container. A rupturable collar is affixed to the periphery of the screw cap in a known manner as a tamper evidence. If the collar of a package on a store shelf is ruptured or severed from the screw cap, this indicates to a consumer that the package has been previously opened and should not be purchased because the contents of the package will no longer be in an aseptic state. However, this device is structurally complicated, and if a cap has been unscrewed and replaced, the tamper evidence can easily be overlooked by a customer in a hurry or by anyone with less than perfect eyesight, since the rupturable plastic portions connecting the collar to the screw cap are only about one millimeter long.

Laid-open Japanese Patent Application No. 64-2727 describes an opening device for the above-mentioned gable-top type of package. This latter device has a frame defining a tubular portion, a sleeve arranged slideably within the tubular portion and connected to the frame by a collapsible bellows, and a cap hinged to the frame and overlying the open uppermost end of the sleeve in a closed position. A user has to apply pressure on the cap, which is transferred to the sleeve, thereby collapsing the bellows. The lower end of the sleeve punctures the packaging material of the container and the reclosable cap can be opened to pour the contents.

However, the cap can be knocked during handling and transportation, thereby inadvertently collapsing the bellows and causing the sleeve to puncture is the underlying packaging material, and thus, the contents of the package will no longer be in an aseptic state. However, if the collapsed bellows is extended to its original position, a consumer is unaware that a previous opening has occurred and could inadvertently purchase such a package and consume its contents, with inherent health risks.

Also known from Japanese utility model patent No. JP-62-90320 is an opening device having a screw cap engaging the screw threads of a spout. The spout is affixed to a package, and a cutting member is provided in the spout. The cutting member can be directly pushed, by exerting pressure thereon with the finger, through the packaging material constituting the package. A mechanism is provided for locking the cutting member in an opened position within the spout, whereby to avoid interference during pouring of the contents of the package. However, the fact that the cutting member is pushed with the finger, is a source of possible contamination of the contents during the opening operation. Furthermore, there is no effective tamper evidence to alert a consumer when a package on the shelf of a store, has been opened and the cap replaced, and thus, the contents of the package will no longer be in an aseptic state. Therefore, a consumer could be unaware that a previous opening has occurred and could inadvertently purchase such a package and consume its contents, with inherent health risks. Furthermore, such type of opening device is inconvenient to use, since it requires a first operation to access the cutter member, and then a second operation to force the cutter member through the packaging material constituting the package.

Laid-open Japanese patent application No. 63-202653 discloses a collar fixable to a package and having a cutting member hingedly connected thereto, for cutting the packaging material of a package to be opened. A spout having a snap-fitting cover or cap hinged thereto, is rotatably mounted on the collar. A cam is supported on the spout and acts on the cutting member when rotating the spout with respect to the collar, thereby forcing the cutting member into the packaging material. causing the sleeve to puncture the underlying packaging material. However, if the spout is rotated with respect to the collar before the package is sold, the contents of the package will no longer be in an aseptic state, and a consumer could inadvertently purchase such a package and consume its contents. This obviously presents a health risk.

OBJECTS OF THE INVENTION.

There is thus a general need in the art to provide a reclosable opening device for packages of flowable or pourable food products which provides a clear and unmistakable signal to the consumer when a package has been tampered with and thus should not be purchased.

One object of the invention is to provide a reclosable opening device for packages of flowable or pourable food products wherein the signal indicative of tampering cannot be returned to its original non-tampered state.

An object of the present invention is to provide an opening device for packages containing a pourable or flowable food product which can be opened in one single operation.

Another object of the invention is to provide an opening device for packages containing a pourable or flowable food product which provides a liquid-tight reclosure of the package after opening.

A further object of the invention is to provide an opening device for packages containing a pourable or flowable food product which can be easily opened by a user without requiring significant force to be applied, whereby spillage of the contents of a package during opening is avoided.

Yet another object of the invention is to provide an opening device having means for automatically rupturing the barrier layer of an aseptic package at the time of opening the package, without thereby requiring a user to handle any part of the opening device that will perforate the packaging material.

A further object of the invention is to provide an opening device wherein means for rupturing a barrier layer of an aseptic package at the time of opening cannot be inadvertently actuated during handling and transportation, thereby maintaining the aseptic quality of the package right up to the moment when the package is opened for consumption of the product contained therein.

DISCLOSURE OF THE INVENTION

With the above objects in view, as well as other objects of the invention which will become apparent hereinafter, there is provided an opening device for packages for pourable food products comprising a frame-like member integratable with a package to be opened, a pouring opening defined by said frame member, a reclosable cap releasably connected to said frame-like member for sealing said pouring opening and removable therefrom for permitting access to said pouring opening, an indicator member associated with said frame-like member and releasably connected to said reclosable cap by rupturable connection means for indicating a sealed condition of said opening device in a first position, characterised in that it comprises indicator locking means interposed between said frame-like member and said indicator member for retaining said indicator member in a second position, which is spaced from said first position, for indicating an opened condition of said reclosable cap.

Further embodiments of the opening device for packages for pourable food products according. to the invention are defined in the sub-claims.

DESCRIPTION OF THE PREFERRED EMBODIMENT.

Figure 7:
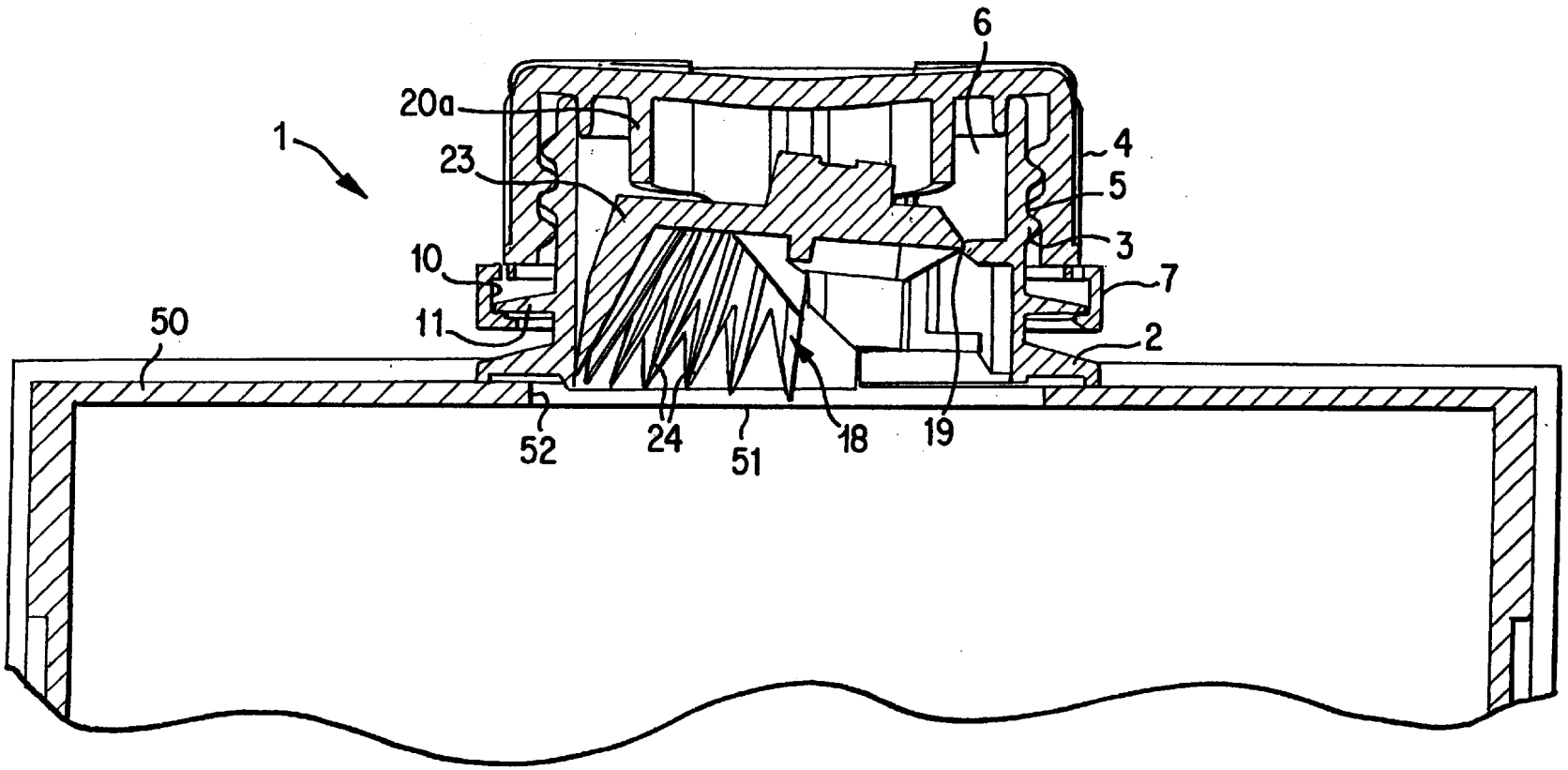
FIG. 7 is an enlarged cross-sectional elevational view of the opening device according to the invention, shown in a closed condition and affixed to a package to be opened.
Figure 8:
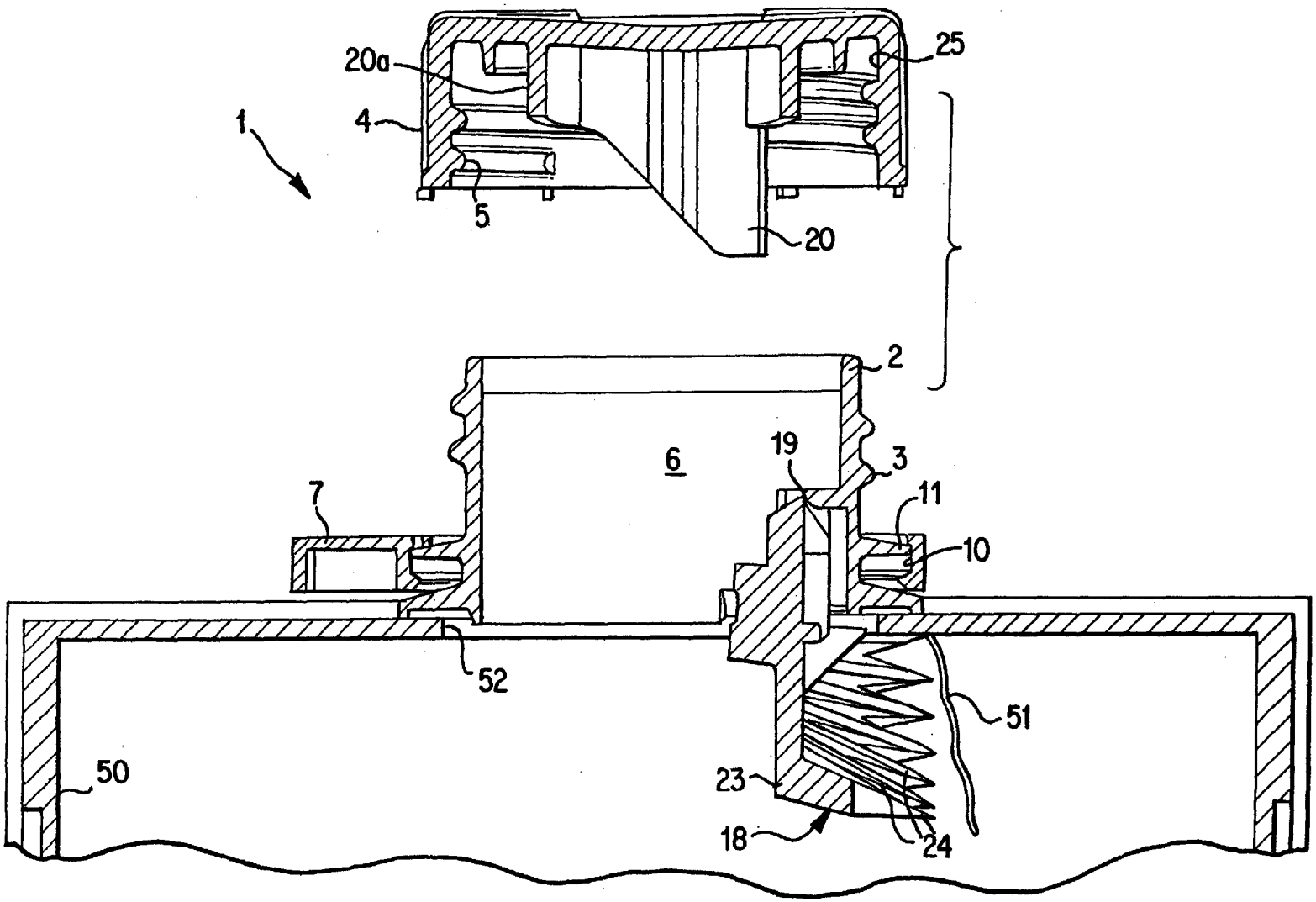
FIG. 8 is an enlarged cross-sectional elevational view of the opening device according to the invention affixed to a package, showing the opening device in an opened condition for opening the package.
Figure 9:
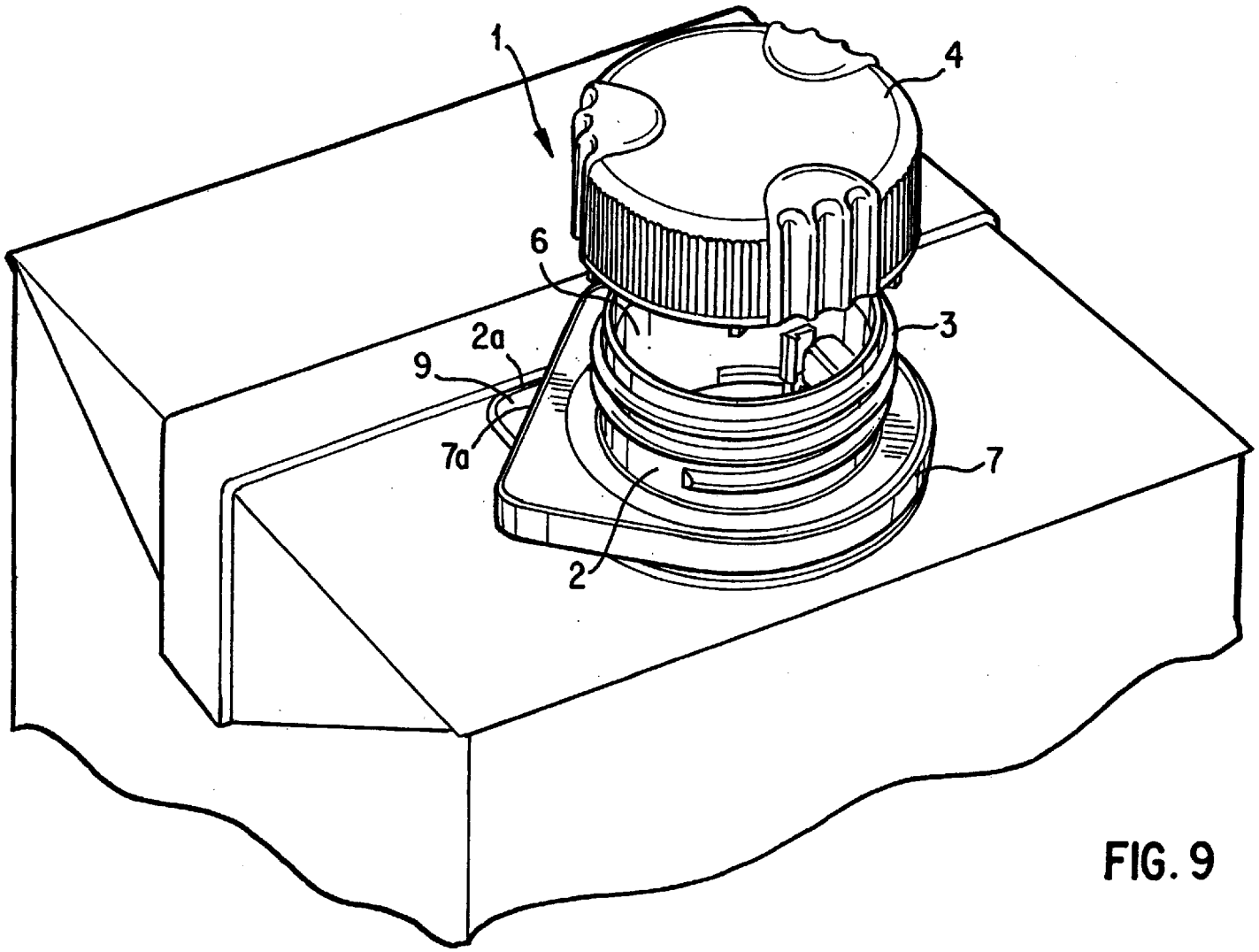
FIG. 9 is a perspective view of the opening device a affixed to a package shown in FIG. 8.

With reference to the above described drawing figures, the reference numeral 1 generally indicates the reclosable opening device for packages for pourable food products according to the invention. The opening device has a frame-like member or frame 2, integratable with a package to be opened, and is preferably affixed thereto, by means such as the application of hot melt adhesive, or techniques such as microflame welding. The frame member 2 is particularly suitable for application on a package 50 made of known laminated paperboard, consisting of layers of fibrous material such as paper, which are coated on either side with a thermoplastic material such as polyethylene. On the side of the laminated packaging material which is destined to be in contact with the food contents of the package, there is also a layer of barrier material such as e.g., aluminum foil, which is also coated with a thermoplastic layer. In the drawing FIGS. 7–9 the laminated structure of the known packaging material constituting the package 50 has been shown schematically, but in order to facilitate understanding of the invention, the portion of the barrier layer 51 which is cut upon opening the package has been iillustrated and indicated with the reference numeral 51. The frame member advantageously circumscribes a reduced thickness portion of the package, i.e., a portion of the package whereat a hole 52 is formed through some of the layers of material, and one or more aluminum and/or polyethylene barrier layers 51 extends over the hole 52. Such configurations are known in the art and are used for forming e.g. perforatable straw holes in packages.

Figure 1:
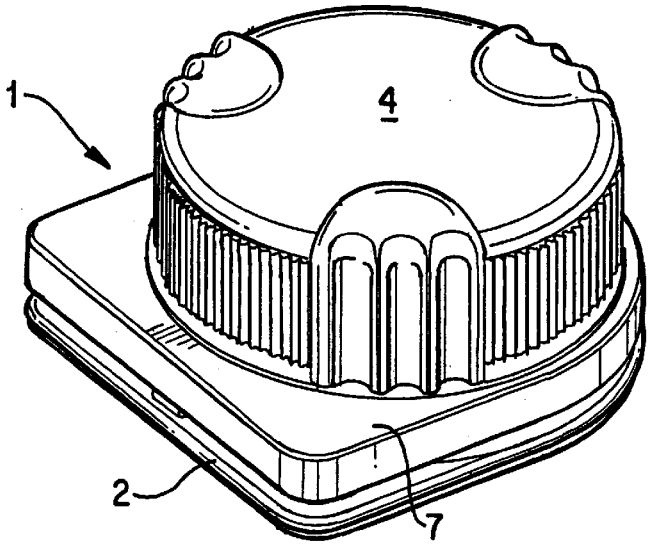
FIG. 1 is a perspective view of the opening device for packages for pourable food products according to the invention, in a closed condition.

The device also has screw threads 3 formed on the frame member 2, and a reclosable cap 4, provided with matingly shaped threads 5, for liquid-tight screw thread engagement with the threads 3 of the frame member 2, for closing a pouring opening 6 defined by the frame 2. An indicator member 7 has formed therein an opening 8 having a diameter which is slightly greater than the external diameter of the screw threads 3. As shown in FIG. 1, the indicator member 7 is located on the frame 2, between the reclosable screw threaded cap 4, and a bottom flange 9 defined by the frame 2.

The indicator member 7 defines an annular groove 10 in sliding rotational engagement with an annular rib 11 formed integrally with the frame 2 below the screw threads 3. Rupturable connection bridges, 12*a*, 12*b*, 12*c*, 12*d*, 12*e*, 12*f* interconnect the cap 4 and the indicator element 7 and indicate a sealed condition of said opening device. In practice, the opening device according to the invention can be assembled by pressure-fitting the indicator member 7, with the cap 4 connected thereto by means of the bridges 12*a*–12*f*, on the frame 2. This causes elastic deformation of the annular rib 11, which snaps into engagement into the annular groove 10, in sliding abutment engagement relationship therewith. Similarly, there also occurs some elastic deformation of the screw threads 3 formed on the frame member 2, and the matingly shaped threads 5 of the reclosable cap 4. This permits the opening device according to the invention to be assembled using conventional pressure-fitting means before being affixed to a package.

The frame and the indicator element each define an outermost peripheral configuration comprising a curved peripheral portion and a linear peripheral portion. With the opening device 1 in an assembled and unopened condition, as shown in FIG. 1, the linear peripheral portion 7*a* of the indicator element 7 is parallel to the linear peripheral portion 2*a* of the frame 2 with the rupturable connection bridges 12*a*–12*f* intact. In this first position, the indicator member 7 completely covers the bottom flange 9 of the frame 2 (see FIG. 1).

Figure 6:
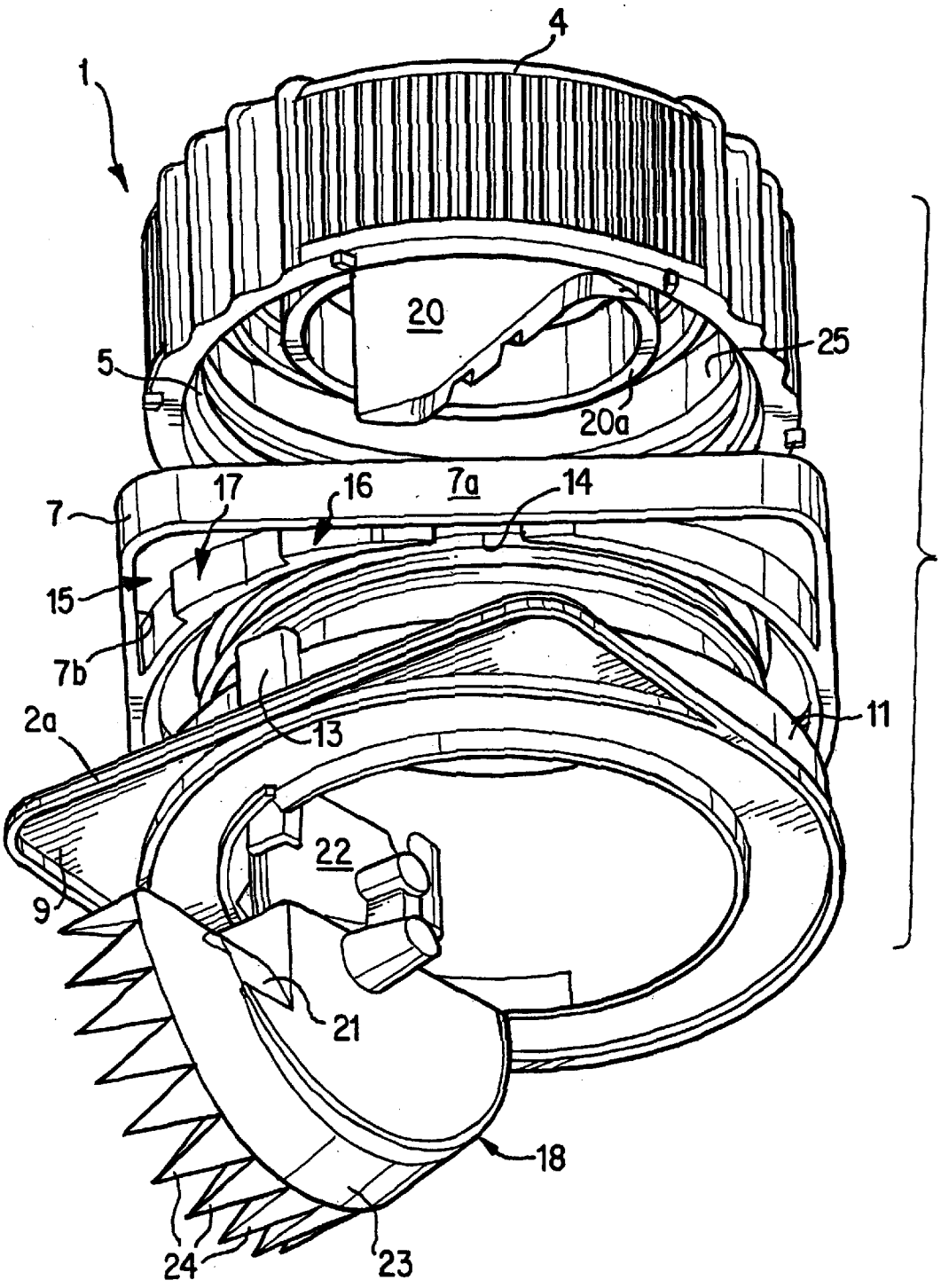
FIG. 6 is an exploded bottom perspective view of the opening device similar to FIG. 5, showing a cutter extending below the frame member and locked to the frame member in an activated condition, and an indicator member interposed between the frame member and the reclosable cap.

The opening device also has indicator locking means interposed between the frame 2 and the indicator member 7 for retaining the indicator member in a second position, which is spaced from said first position, for indicating an opened condition of said reclosable cap. i.e., a position whereat the linear peripheral portion 7*a* of the indicator element 7 is angularly displaced with respect to the linear peripheral portion 2*a* of the frame 2 with the rupturable connection bridges 12*a*–12*f* in a broken condition (see FIG. 6).

Figure 5:
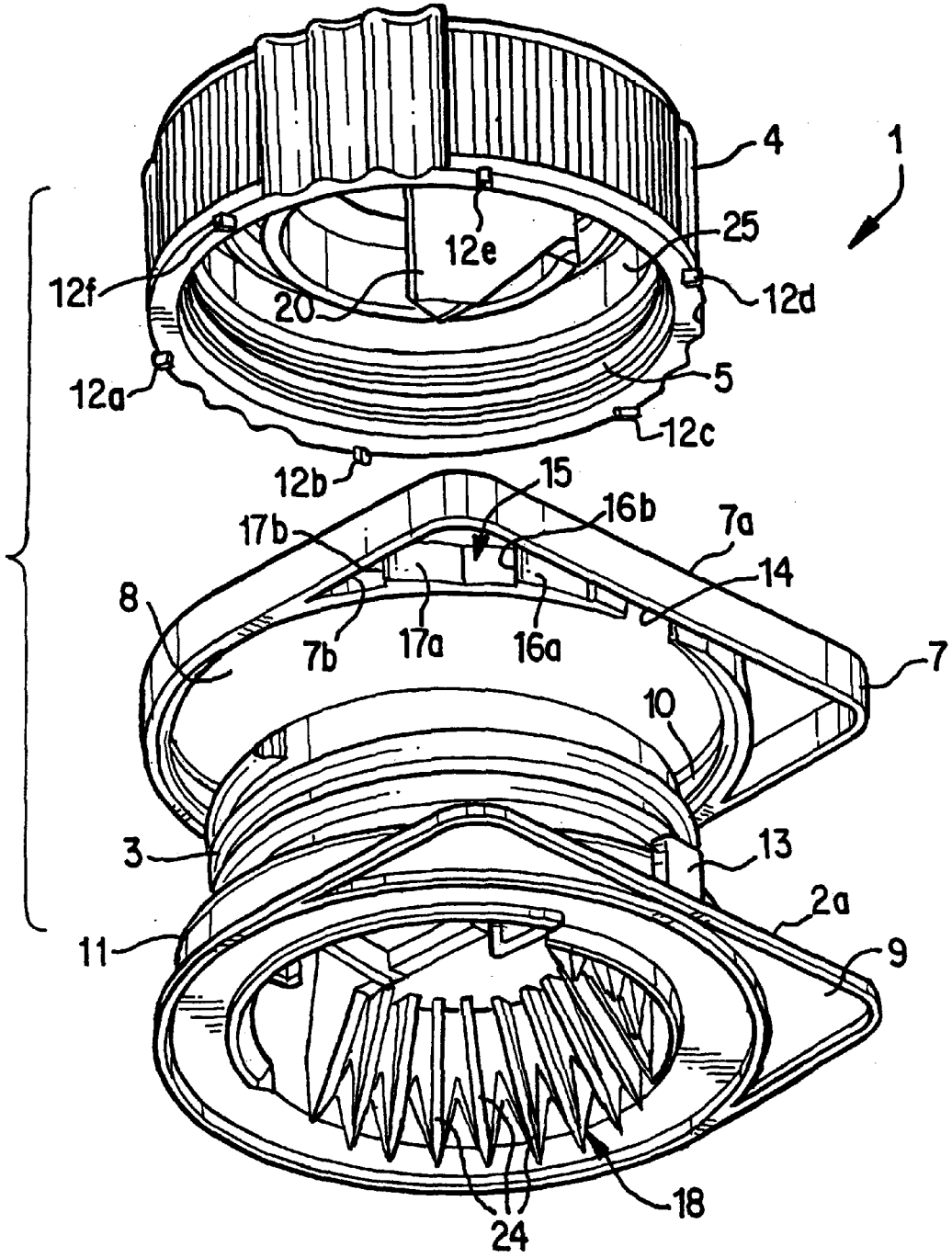
FIG. 5 is an exploded bottom perspective view of the opening device according to the invention, showing a cutter accommodated inside the frame member, and an indicator member interposed between the frame member and he reclosable cap.

The indicator locking means comprise non-reversible ratchet means including a pin 13 connected to the frame 2, which is housed in a recess 14 formed in the indicator member 7 when the device is in an unopened condition, as shown in FIGS. 1 and 5. The non-reversible ratchet means also include a toothed ratchet 15 connected to the indicator member 7. The pin 13 is non-reversibly slideable over the toothed ratchet 15 in an opening direction, i.e., an anti-clockwise rotational direction, defined by the reclosable cap 4. End stop means constituted by an internal wall 7*b* of the indicator member 7 (see FIG. 5), delimit the excursion of the indicator member 7 with respect to the pin 13 in the opening direction.

The pin 13 protrudes from the frame 2 in a direction substantially parallel to the axis of the pouring opening 6 when located in a normal non-flexed position. The toothed ratchet 15 has at least one tooth, and preferably has at least two teeth 16, 17 each having an inclined surface 16*a*, 17*a*, and an abutment wall 16*b*, 17*b*. The pin 13 is elastically axially displaced from the normal non-flexed position when sliding over the inclined surfaces 16*a*, 17*a* of each of the teeth 16, 17, and returns elastically to its normal non-flexed position when located adjacent to the abutment wall 16*b*, 17*b* of each of the teeth 16,17.

Figure 2:
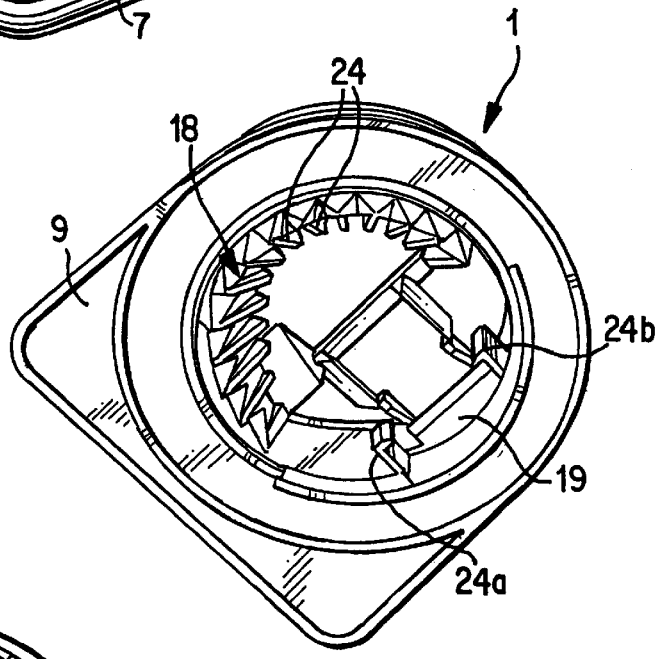
FIG. 2 is a bottom perspective view of a frame member of the opening device according to the invention.
Figure 3:
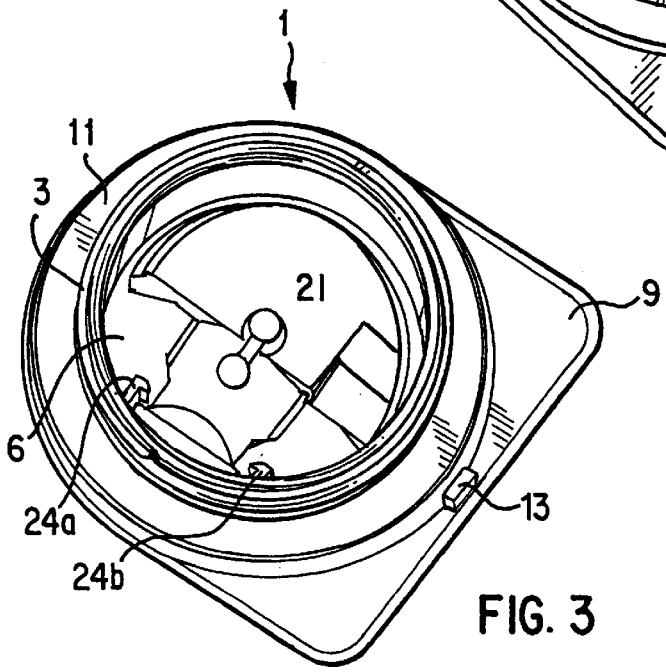
FIG. 3 is a top perspective view of the frame member of the opening device according to the invention.
Figure 4:
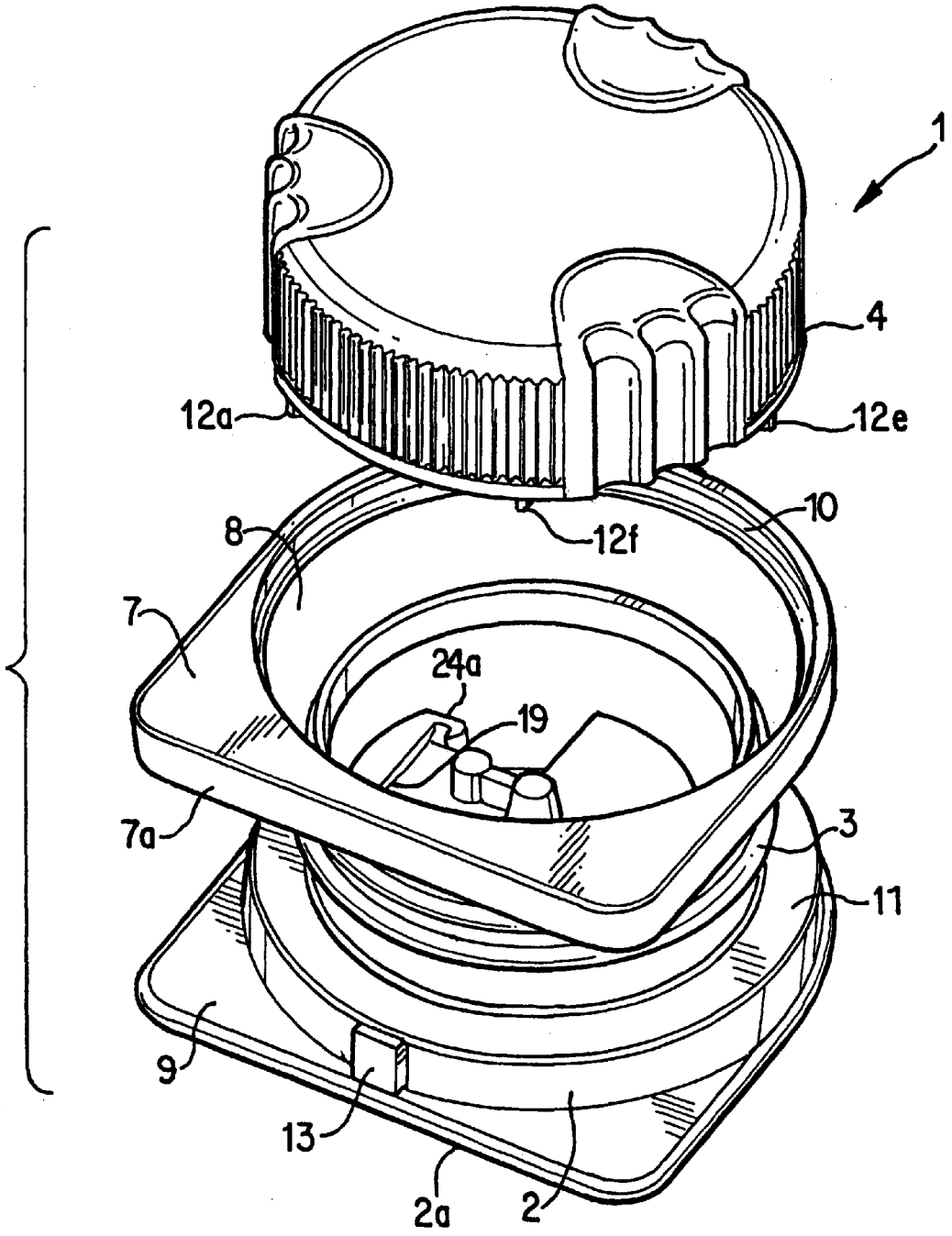
FIG. 4 is an exploded top perspective view of the opening device according to the invention, showing the frame member, a reclosable cap, and an indicator member interposed between the frame member and the reclosable cap.

A cutter 18 is movably connected to the frame 2, and is movable with respect to the frame 2 from a first position (see FIGS. 2 and 5), whereat the cutter 18 is accommodated within the pouring opening 6 of the frame 2, to a second position (see FIG. 6), whereat the cutter 18 protrudes below the frame 2, for perforating a portion of a package. The cutter 18 is preferably formed integrally with an elastic hinge 19 which, in turn, is preferably formed integrally with the frame 2.

Actuation means are formed integrally with the reclosable cap for moving the cutter 18 from the first position to the second position upon opening the reclosable cap 4. The actuation means comprise a cam 20 formed integrally with the reclosable cap 4, and an inclined surface 21 provided on the cutter 18. The cam 20 protrudes from a rib 20*a* provided on the internal upper surface of the cap 4. The cam 20 and the rib 20*a* are spaced radially inwards from the inner annular wall 25 of the cap 4 by a distance which is slightly greater than the threaded portion of the frame 2, whereby to permit rotation of the cap 4 and cam 20 with respect to the frame 2 and the inclined cam surface 21 of the cutter 18. This allows the cam 20 to act on the inclined cam surface 21 when moving the cap 4 with respect to the frame 2 in an opening direction, i.e., in an anti-clockwise direction.

Cutter locking means are also formed integrally with the frame 2 for locking the cutter 18 in said second position, i.e., in the fully lowered position shown in FIG. 6. More precisely, the cutter 18 comprises an arm 22, an arcuate member 23 formed integrally with the arm 22, and a plurality of cutting teeth 24 formed integrally with the arcuate member 23. The locking means comprise at least one, and preferably a pair of, mutually opposed hook-like elements 24*a*, 24*b*, formed integrally with the frame 2. The hook-like elements 24*a*, 24*b* flex elastically apart during passage of the arm 22 of the cutter 18, between the first raised position and the second lowered second position, and non-releasably engage the arm 22 of the cutter in the lowered position, as shown in FIG. 6. In this way, the cutter perforates the packaging material and creates an opening in the wall of a package where the opening device is affixed. The cutter locking means prevent any return movement of the cutter and thereby prevent any interference with the pouring opening 6 once the package has been opened.

The operation of the reclosable opening device according to the invention is the following:

The opening device is affixed to a package in the condition shown in FIG. 1. A user wishing to open the package grips the cap 4 and rotates it in an anti-clockwise direction. Initially, the indicator element 7 rotates together with the cap 4, and the pin 13 of the frame 2 irreversibly travels over the teeth 16, 17 of the ratchet mechanism 15. At the same time, the annular rib 11 of the frame slides within the annular groove 10 of the indicator element.

When the pin 13 abuts against the end stop means constituted by the internal wall 7*b* of the indicator member 7, continued rotation of the cap 4 20 causes breakage of the connecting bridges 12*a*-12*f*. At this point, the pin 13 is non-reversibly locked in a second position between the wall 7*b* of the indicator member 7 and the abutment wall 17*b* of the second tooth 17. In this position, the linear peripheral portion 7*b* of the indicator member 7*a* is misaligned with respect to the linear peripheral portion 2*a* of the frame 2, thereby exposing portions of the bottom flange 9 defined by the frame 2 (see FIGS. 6 and 9). Thus, there is provided an immediately visible evidence that the package has been opened. It will be appreciated that the bottom flange 9 can be coloured differently with respect to the indicator member 7, whereby to accentuate the tamper evidence. Thus, a consumer who observes a package in this condition in a store, is immediately aware that the package has been tampered with and should not be purchased.

By continuing rotation of the cap 4 with respect to the frame 2, since the indicator element 7 is locked to the frame 2, the internal threads 5 of the cap 4 start to unscrew from the threads 3 of the frame 2, and the cam 20 acts on the inclined cam surface 21, thereby rotating the cutter 18 about the elastic hinge 19, and lowering the cutter 18. This lowering of the cutter 18 cuts through the layer of barrier material 51 extending across the hole 52 formed in the remaining layers of the laminated packaging material constituting the package 50. When the cutter 18 reaches the fully lowered position shown in FIGS. 6 and 9, the hook-like members 24*a*, 24*b* engage the arm 22 of the cutter 18. The cutter is thus prevented from returning and obstructing the pouring opening 6 during use of the opened package 50. The severed portion of barrier material 51 is also prevented from obstructing the hole 52 and the pouring opening 6 during use of the opened package 50. The opening device is reclosed after use by simply replacing the screw cap 4.

It should be noted that adhesion occurring between the barrier material 51 on the inside of the package 50 and the plastic layer provided on the outside of the package effectively seals any fibres of the fibrous layers of the packaging material which would otherwise be exposed at the hole 52, thereby achieving an edge-sealing effect and preventing any so called "edge-soaking" or wicking of the product into the packaging material. The cutter is advantageously dimensioned, with respect to the hole 52, such that it cuts the barrier layer at a point located at a small distance away from the edge of the hole 52, thereby maintaining this edge-sealing of the packaging material around the periphery of the hole 52, even after the package 50 has been opened.

The present invention may be modified without thereby departing from he purview of the appended claims.

What is claimed is:

1. A reclosable opening device for packages for pourable food products comprising a frame member integratable with a package to be opened, a pouring opening defined by said frame member, a reclosable cap releasably connected to said frame member for sealing said pouring opening and removable therefrom for permitting access to said pouring opening, an indicator member associated with said frame member and releasably connected to said reclosable cap by rupturable connection means for indicating a sealed condition of said opening device in a first position, said opening device further comprising indicator locking means interposed between said frame member and said indicator member for retaining said indicator member in a second position, which is spaced from said first position, for indicating an opened condition of said reclosable cap, and wherein said indicator locking means comprise non-reversible ratchet means.

2. A reclosable opening device for packages for pourable food products comprising a frame member integratable with a package to be opened, a pouring opening defined by said frame member, a reclosable cap releasably connected to said frame member for sealing said pouring opening and removable therefrom for permitting access to said pouring opening, an indicator member associated with said frame member and releasably connected to said reclosable cap by rupturable connection means for indicating a sealed condition of said opening device in a first position, said opening device further comprising indicator locking means interposed between said frame member and said indicator member for retaining said indicator member in a second position, which is spaced from said first position, for indicating an opened condition of said reclosable cap, and wherein said indicator locking means comprise a toothed ratchet connected to said indicator member, at least one pin connected to said frame member and non-reversibly slideable over said toothed ratchet in an opening direction defined by said reclosable cap, and end stop means delimiting the excursion of said at least one pin in said opening direction.

3. A reclosable opening device for packages for pourable food products comprising a frame member integratable with a package to be opened, a pouring opening defined by said frame member, a reclosable cap releasably connected to said frame member for sealing said pouring opening and removable therefrom for permitting access to said pouring opening, an indicator member associated with said frame member and releasably connected to said reclosable cap by rupturable connection means for indicating a sealed condition of said opening device in a first position, said opening device further comprising indicator locking means interposed between said frame member and said indicator member for retaining said indicator member in a second position, which is spaced from said first position, for indicating an opened condition of said reclosable cap, and wherein said frame member has screw threads formed thereon and an annular rib, said reclosable cap has a threaded portion for engagement with said screw threads, and said indicator element defines an annular groove in sliding rotational engagement with said annular rib.

4. A reclosable opening device for packages for pourable food products comprising a frame member integratable with a package to be opened, a pouring opening defined bv said frame member, a reclosable cap releasably connected to said frame member for sealing said pouring opening and removable therefrom for permitting access to said pouring opening, an indicator member associated with said frame member and releasably connected to said reclosable cap by rupturable connection means for indicating a sealed condition of said opening device in a first position, said opening device further comprising indicator locking means interposed between said frame member and said indicator member for retaining said indicator member in a second position, which is spaced from said first position, for indicating an opened condition of said reclosable cap, and at least one cutter movably connected to said frame member, said cutter being movable with respect to said frame member from a first position, whereat said cutter is accommodated within said frame member, to a second position, whereat said cutter protrudes below said frame member, for perforating a portion of a package.

5. A reclosable opening device for packages for pourable food products according to claim 4, further comprising actuation means formed integrally with said reclosable cap for moving said cutter from said first position to said second position upon opening said reclosable cap.

6. A reclosable opening device for packages for pourable food products according to claim 4, further comprising cutter locking means formed integrally with said frame member for locking said cutter in said second position.

7. A package for pourable food products comprising a reclosable opening device which comprises a frame member integratable with a package to be opened, a pouring opening defined by said frame member, a reclosable cap releasably connected to said frame member for sealing said pouring opening and removable therefrom for permitting access to said pouring opening, an indicator member associated with said frame member and releasably connected to said reclosable cap by rupturable connection means for indicating a sealed condition of said opening device in a first position, said opening device further comprising indicator locking means interposed between said frame member and said indicator member for retaining said indicator member in a second position, which is spaced from said first position, for indicating an opened condition of said reclosable cap, and wherein said package comprises a reduced thickness portion, said frame member being connected to said package and circumscribing said reduced thickness portion.

8. A package according to claim 7, wherein said reduced thickness portion circumscribed by said frame member constitutes an aseptic barrier layer of said package.

* * * * *